United States Patent [19]

Morita et al.

[11] Patent Number: 4,995,338

[45] Date of Patent: Feb. 26, 1991

[54] COATING APPARATUS

[75] Inventors: Hirobumi Morita; Eiichi Matsuzaki; Yukio Chiba; Shigeo Kato, all of Sayama, Japan

[73] Assignee: Honda Giken Kogyo Kabushiki Kaisha, Tokyo, Japan

[21] Appl. No.: 247,853

[22] Filed: Sep. 22, 1988

[30] Foreign Application Priority Data

Sep. 24, 1987 [JP] Japan ..... 62-241997
Nov. 18, 1987 [JP] Japan ..... 62-175035[U]

[51] Int. Cl.[5] ..... B05C 1/04
[52] U.S. Cl. ..... 118/410; 118/419
[58] Field of Search ..... 118/410, 405, 407, 419

[56] References Cited

U.S. PATENT DOCUMENTS

| | | | |
|---|---|---|---|
| 1,857,218 | 5/1932 | Sawyer et al. | 118/410 |
| 2,098,347 | 11/1937 | MacKenzie | 118/410 |
| 2,208,694 | 7/1940 | Barbati | 118/410 |
| 2,216,122 | 10/1040 | MacKenzie | 118/410 |
| 2,464,771 | 3/1949 | Van Guelpin | 118/410 |
| 2,663,886 | 12/1953 | Jester | 118/410 |
| 2,677,835 | 5/1954 | Kamborian | 118/410 |
| 3,490,413 | 1/1970 | Kamborian et al. | 118/410 |
| 3,873,258 | 3/1975 | Ratliff | 118/410 |
| 4,508,051 | 5/1985 | Bast | 118/410 |
| 4,605,569 | 8/1986 | Shimada et al. | 427/256 |
| 4,744,330 | 5/1988 | Claasen | 118/410 |
| 4,809,885 | 3/1989 | Hayashi et al. | 118/410 |

*Primary Examiner*—Willard E. Hoag

[57] ABSTRACT

A coating apparatus for coating an object with a coating material in a coating direction includes a holder adapted to be mounted on a controllable support member, a shaft slidably supported in the holder, and a head member mounted on the shaft for angular movement in a direction transverse to the coating direction, the head member having a sliding surface for slidable contact with the object and a coating material outlet positioned forwardly of the sliding surface in the coating direction. In another embodiment, the head member has sliding legs for sliding contact with the object at front and rear positions in the coating direction, at least one of the sliding legs having a recess defined therein to provide a gap between the sliding leg and the object, the gap having a prescribed width in a direction transverse to the coating direction. The head has a coating material outlet defined between the sliding legs and a concave coating material reservoir defined between the sliding legs for temporarily storing the coating material supplied form the coating material outlet and for supplying the stored coating material into the recess.

19 Claims, 8 Drawing Sheets

COATING APPARATUS

BACKGROUND OF THE INVENTION

The present invention relates to a coating apparatus, and more particularly to a coating apparatus for coating a primer to a window glass panel to be mounted in an automobile body, the coating apparatus having a head member slidable along an area of the window glass panel which is to be coated with an adhesive, the head member having a coating material outlet for supplying a primer and slidable to spread the supplied primer over the area.

When installing a window glass panel in an automobile body, for example, an adhesive is coated on the peripheral edge of the window glass panel, and the window glass panel is firmly attached to the automobile body by the bonding strength of the adhesive. For keeping the adhesive firmly bonded to the window glass panel, it is general practice to coat the peripheral edge of the window glass panel, i.e., an area of the window glass pane where the adhesive will be applied, with a primer before the adhesive is coated.

Heretofore, a brush has been used in many instances to coat a primer on a window glass panel. According to one known coating process, for example, a brush is installed on a robot arm and slidably displaced along an area of the window glass panel to be coated, while at the same time a metered amount of primer is supplied to the brush, for thereby automatically coating the primer on the entire area.

The above conventional coating process is however disadvantageous in that since the primer is applied using the brush, it is difficult to apply a primer coating layer of a desired width and a uniform thickness to the area. The coated primer may be applied to a portion of the window glass panel where no primer coating should be applied, and the coated primer layer may not have a sufficient thickness which is thick enough to remain well adhered to an adhesive which will be applied subsequently.

Moreover, after the primer has been coated, the solvent contained in the primer retained in the brush may be evaporated making the surface of the bush hard before the brush will be used in a next coating process. If the brush with the hard surface were used again in the next coating process, it would be impossible to provide a primer coating layer having a uniform layer thickness. As a result, a tedious maintenance procedure is required to keep the brush ready for use at all times.

Another problem with the use of the brush is that the brush is not highly durable and cannot remain usable continuously for a long period of time.

SUMMARY OF THE INVENTION

It is a primary object of the present invention to provide a coating apparatus having a head member mounted on a robot arm or the like and slidably displaceable along an object to be coated, the head member having a recess to define a gap between the head member and the object, the coating apparatus being operable such that a primer is coated on the object through the recess of the head member while moving the head member for reliably producing a primer coating layer having a prescribed width and a uniform layer thickness on the object, the coating apparatus being highly durable and usable effectively for a long period of time.

Another object of the present invention is to provide a coating apparatus for coating an object with a coating material in a coating direction, comprising: a holder adapted to be mounted on a controllable support member; a shaft slidably supported in the holder; and a head member mounted on the shaft for angular movement in a direction transverse to the coating direction, the head member having a sliding surface for slidable contact with the object and a coating material outlet positioned forwardly of the sliding surface in the coating direction.

By coating direction as herein used is meant a direction in which the head is slidably movable on a substrate to be coated.

Still another object of the present invention is to provide a coating apparatus wherein the sliding surface has a recess defined therein to provide a gap between the sliding surface and the object, the gap having a prescribed width in a direction transverse to the coating direction.

Yet another object of the present invention is to provide a coating apparatus wherein the head member is angularly movably mounted on the shaft by a connector, the connector having a passage having one end communicating with the coating material outlet and an opposite end adapted to communicate with a coating material supply source.

Yet still another object of the present invention is to provide a coating apparatus wherein the head member has a slanted surface inclined upwardly substantially from the sliding surface in the coating direction, the coating material outlet being defined in the slanted surface.

Another object of the present invention is to pro vide a coating apparatus wherein the coating material outlet comprises a slit-like opening extending in a direction transverse to &he coating direction.

A further object of the present invention is to provide a coating apparatus wherein the shaft is slidably supported in the holder under the bias of a resilient member, the shaft having an engaging pin and the holder having a slot in which the engaging pin is fitted, the shaft being guided by the engaging pin and the slot.

It is also an object of the present invention to provide a coating apparatus for coating an object with a coating material in a coating direction, comprising: a holder adapted to be mounted on a controllable support member; a shaft slidably supported in the holder; and a head member mounted on the shaft, the head member having sliding legs for sliding contact with the object at front and rear positions in the coating direction, at least one of the sliding legs having a recess defined therein to provide a gap between the sliding leg and the object, the gap having a prescribed width in a direction transverse to the coating direction, the head having a coating material outlet defined between the sliding legs and a concave coating material reservoir defined between the sliding legs for temporarily storing the coating material supplied from the coating material outlet and for supplying the stored coating material into the recess.

A further object of the present invention is to provide a coating apparatus wherein the shaft is vertically movable and normally urged downwardly by a resilient member, the head member being swingably mounted on a distal end of the shaft for swinging movement in the coating direction and a direction transverse to the coating direction.

A still further object of the present invention is to provide a coating apparatus further including a clevis mounted on the distal end of the shaft, a support member swingably mounted on the clevis for swinging movement in a first direction, the head member having a head clevis engaging the support member for swinging movement in a direction transverse to the first direction.

A yet further object of the present invention is to provide a coating apparatus wherein the holder has a check valve disposed above the shaft supported therein and a coating material supply path communicating with the coating material outlet through the check valve, the check valve being selectively openable and closable by sliding displacement in the holder.

A yet further object of the present invention is to provide a coating apparatus wherein the sliding legs have respective inner surfaces defining the coating material reservoir therebetween and inclined upwardly toward each other.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
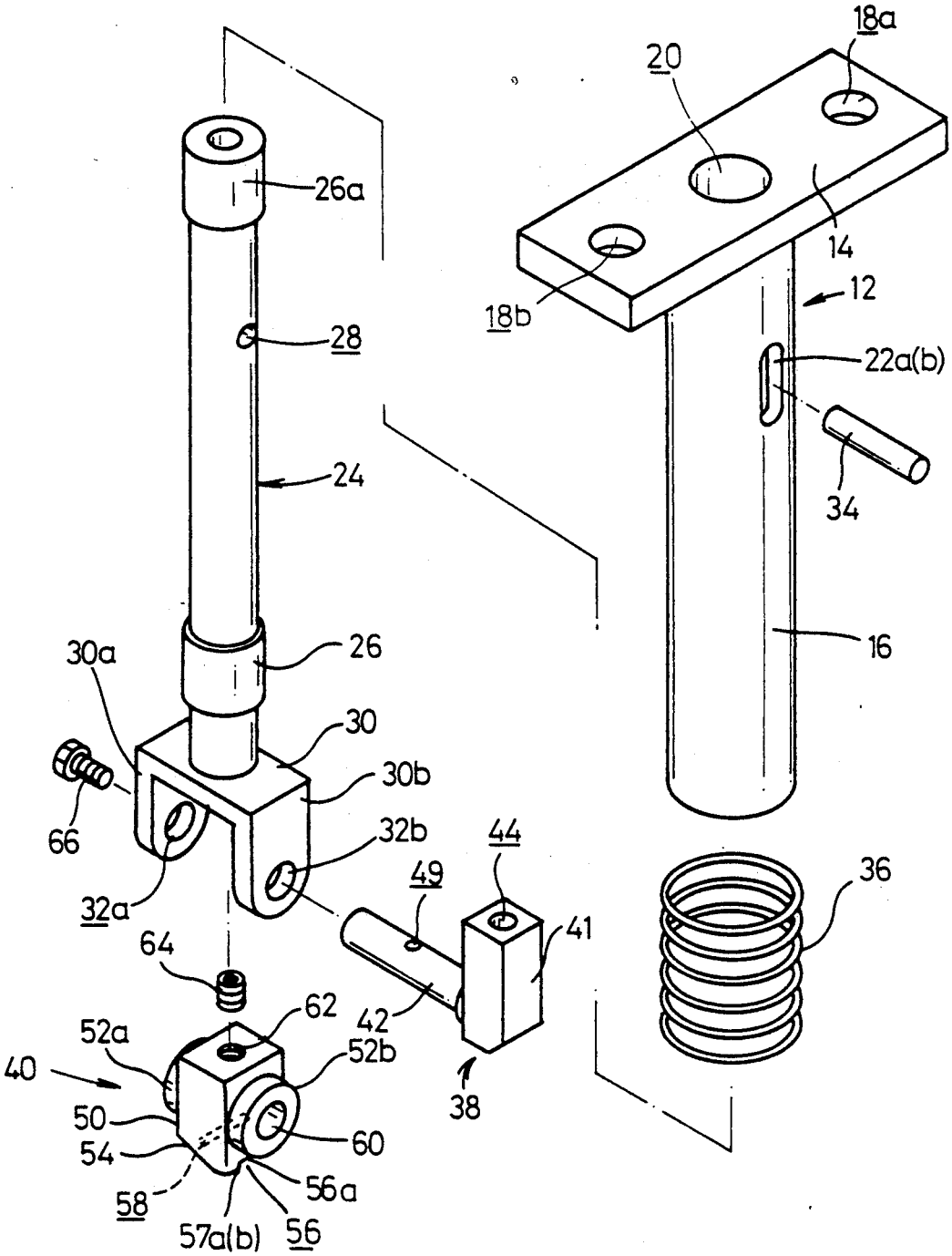
FIG. 1 is an exploded perspective view of a coating apparatus according to the present invention.
Figure 2:
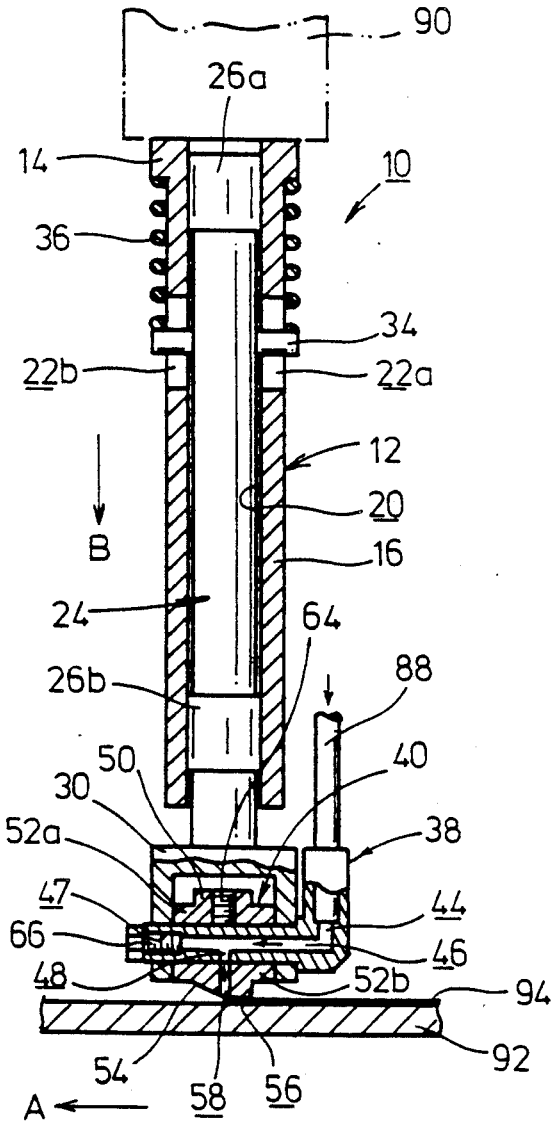
FIG. 2 is a fragmentary vertical cross-sectional view of the coating apparatus.
Figure 3:
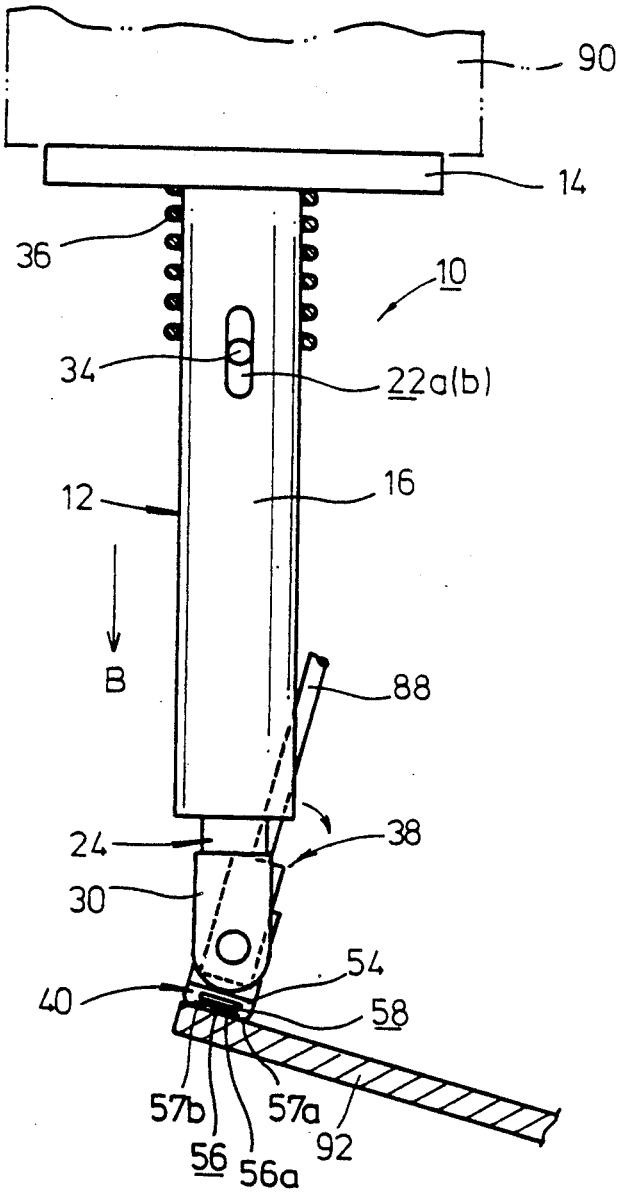
FIG. 3 is a view explaining opera&ion of the coating apparatus.

As shown in FIGS. 1 through 3, a coating apparatus, generally designated by the reference numeral 10, according to an embodiment of the present invention includes a holder 12 comprising a rectangular attachment 14 and a cylindrical member 16 mounted perpendicularly to the attachment 14. The attachment 14 includes holes 18*a*, 18*b* defined in the opposite ends thereof. A hole 20 is defined in the attachment 14 between the holes 18*a*, 18*b* and extends into the cylindrical member 16. The cylindrical member 16 has a pair of oblong slots 22*a*, 22*b* defined in its wall in diametrically opposite relation, the slots 22*a*, 22*b* extending axially over a certain length. The slots 22*a*, 22*b* communicate with the hole 20 in the cylindrical member 16.

A shaft 24 is slidably fitted in the hole 20 in the cylindrical member 16 of the holder 12. The shaft 24 has larger-diameter portions or lands 26*a*, 26*b* on its upper end and lower end portion, respectively, the lands 26*a*, 26*b* being closely fitted in the hole 20. A diametrical hole 28 is defined through the shaft 24 near the land 26*a*. A holder member 30 of a U-shaped cross section is attached to the lower end of the shaft 24 and includes a pair of parallel, spaced side plates 30*a*, 30*b* having respective coaxial holes 32*a*, 32*b* therein.

The shaft 24 is fitted in the hole 20 in the cylindrical member 16, and an engaging pin 34 is pressed into the hole 28 in the shaft 24, with the opposite ends of the engaging pin 34 being placed in the respective slots 22*a*, 22*b*. A compression coil spring 36 is disposed around the cylindrical member 16 between the engaging pin 34 and the attachment 14. Therefore, the shaft 24 is normally urged downwardly with respect to the cylindrical member 16 at all times under the resilient forces of the coil spring 36.

Figure 4:
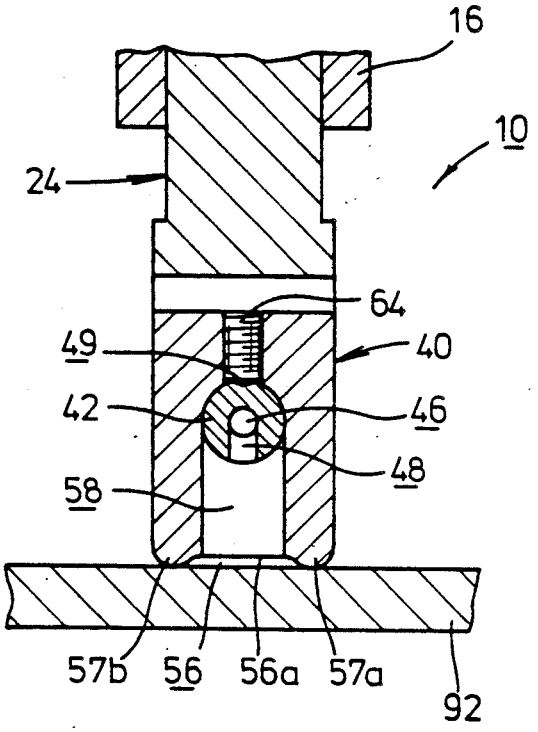
FIG. 4 is an enlarged fragmentary vertical crosssectional view of the coating apparatus.

A head member 40 is rotatably mounted on the holder member 30 of the shaft 24 by means of a connector 38. The connector 38 includes a block 41 in the form of a rectangular parallelepiped and a cylindrical member 42 extending perpendicularly from the block 41. As shown in FIG. 2, the block 41 has a central passage 44 defined therein and held in communication with a passage 46 defined axially centrally through the cylindrical member 42. An internally threaded hole 47 is defined in he cylindrical member 42 at an end of the passage 46 in communication therewith. The cylindrical member 42 also has a hole 48 defined therein and extending perpendicularly to an intermediate portion of the passage 46 in communication therewith, the hole 48 being open at the outer peripheral surface of the cylindrical member 42. A V shaped groove or notch 49 (FIG. 4) is defined in the outer peripheral surface of the cylindrical member 42.

The head member 40 comprises a main body 50 in the form of a rectangular parallelepiped and a pair of rings 52*a*, 52*b* integrally formed with opposite sides of the main body 50. The main body 50 has a lower slanted surface 54 inclined downwardly from the ring 52*a* toward the ring 52*b*. The slanted surface 54 has a recess 56 defined in the lower end thereof and having a prescribed width in a direction normal to a coating direction indicated by the arrow A in FIG. 2. The recess 56 is defined by a wall surface 56*a* which is substantially flat (see FIG. 4). The wall surface 56*a* may alternatively be of any of suitable shapes such as an arcuate shape.

The main body 50 has a pair of sliding legs 57*a*, 57*b* disposed one on each side of the wall surface 56*a* for sliding contact with an object to be coated. The ends of the sliding legs 57*a*, 57*b* should preferably be rounded to prevent the object from being damaged by the sliding engagement with the sliding legs 57*a*, 57*b*. The slanted surface 54 has a slit like opening 58 extending over a prescribed length in a direction which is substantially normal to the slanting direction of the surface 54. The opening 58 communicates with a hole 60 which is defined all the way through the rings 52*a*, 52*b* and the main body 50. The main body 50 has an internally threaded hole 62 defined in the upper surface thereof and held in communication with the hole 60, and a setscrew 64 is threaded in the hole 62.

For assembly, the head member 40 of such a con struction is fitted between the side plates 30*a*, 30*b* of the holder member 30 of the shaft 24. The cylindrical member 42 of the connector 38 is inserted through the holes 32*a*, 32*b* in the side plates 30*a*, 30*b* and the hole 60 in the head member 40. The setscrew 64 threaded in the hole 62 in the main body 50 is turned until its tip end engages in the notch 49 of the cylindrical member 42, thus fixing the head member 40 to the cylindrical member 42. The head member 40 and the connector 38 are now angularly movably mounted on the holder member 30. A bolt 66 is threaded into the internal hole 47 in the cylindrical member 42 of the connector 38 to close off the end of the passage 46.

A primer supply system for supplying a primer to the coating apparatus 10 will be described with reference to FIG. 5.

Figure 5:
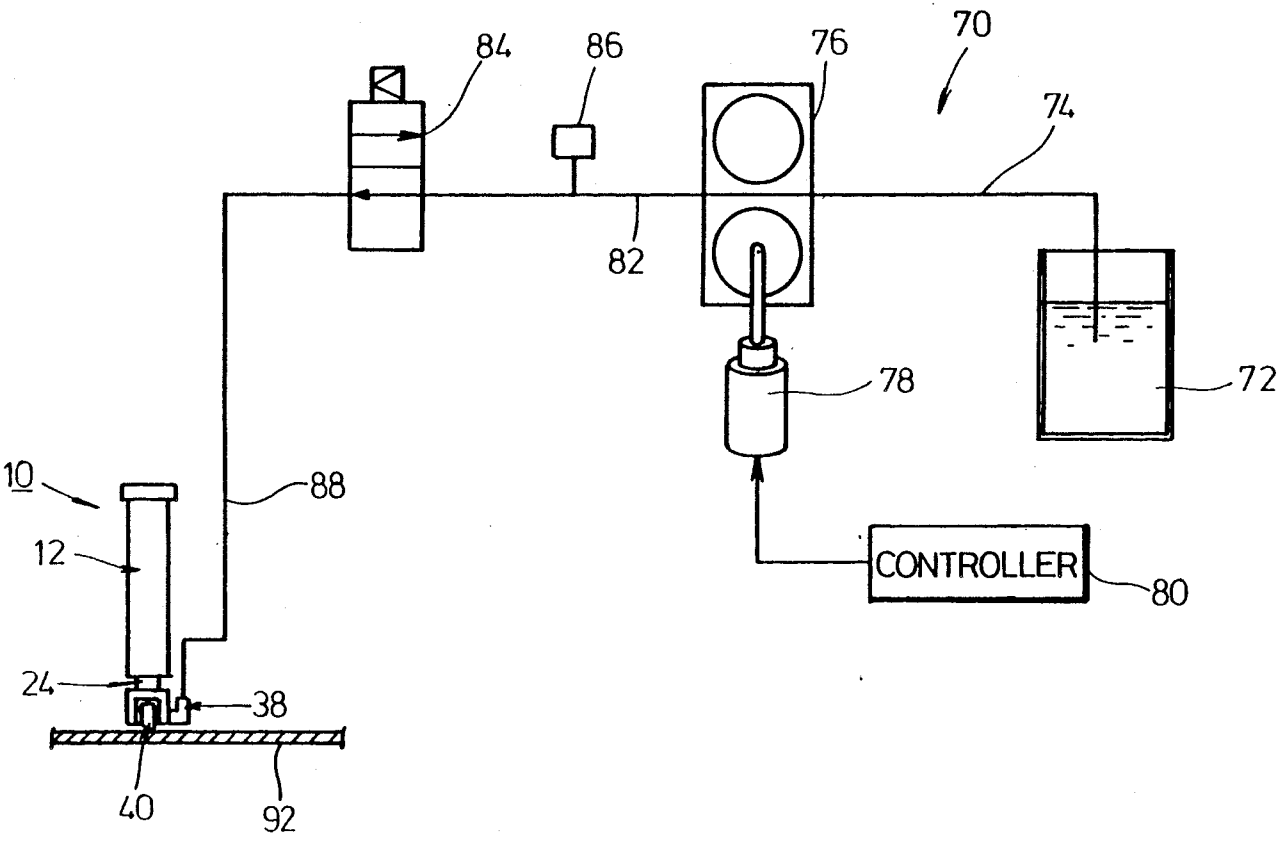
FIG. 5 is a schematic view of a primer supply system for the coating apparatus.

As shown in FIG. 5, the primer supply system, generally indicated at 70, includes a tank 72 for storing a primer therein. A pipe 74 has one end immersed in the primer stored in the tank 72 and the other end coupled to a fixed-displacement pump 76. The fixed-displacement pump 76 is actuatable by a variable-speed motor 78 which is controlled for its speed of rotation by a controller 80. To the fixed displacement pump 76, there is connected a pipe 82 coupled to a directional control valve 84 with a pressure sensor 86 coupled to the pipe 82 at a point between the fixed-displacement pump 76 and the directional control valve 84. A pipe 88 extends from the directional control valve 84 to the block 41 of the connector 38 in communication with the passage 44. Thus, the pipe 88 communicates with the opening 58 in the head member 40 through the passages 44, 46 and the hole 48 (see FIG. 2).

The coating apparatus of the aforesaid embodiment is basically constructed as described above. Operation and advantages of the coating apparatus will be described below.

Figure 9:
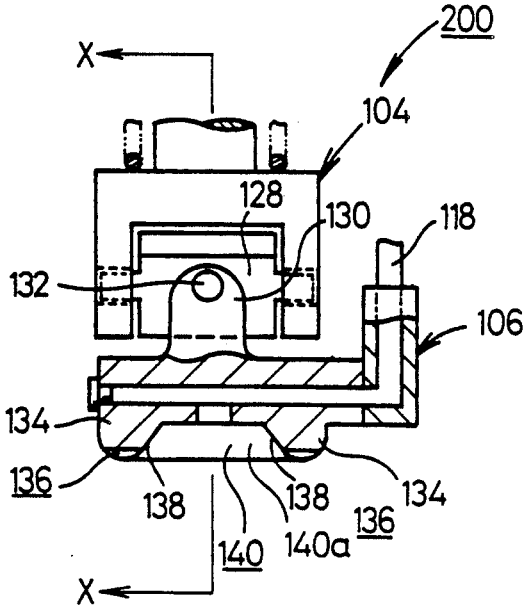
FIG. 9 is a fragmentary cross-sectional view of a coating apparatus according Lo still another embodiment of the present invention.
Figure 10:
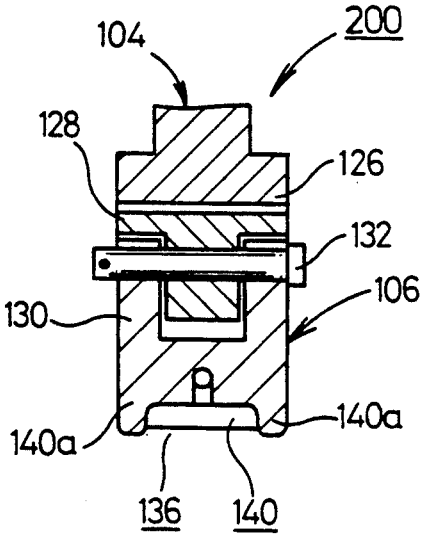
FIG. 10 is a cross sectional view taken along line X—X of FIG. 9.

A bolt or the like (not shown) is inserted through the holes 18*a*, 18*b* in the attachment 14 to fasten the holder 12 to a robot arm 90, for example (FIGS. 9 and 10). An object to be created which has been degreased, such as a window glass panel 90 for use in an automobile, is installed in a primer coating position. The robot arm 90 is operated to displace the coating apparatus 10 with respect to the window glass panel 92.

With the head member 40 abutting against the window glass panel 92, the robot arm 90 is further displaced toward the window glass panel 92 in the direction of the arrow B (FIG. 2). The shaft 24 with the head member 40 mounted thereon is stopped against the window glass panel 92, whereas the holder 12 is displaced in the direction of the arrow B with respect to the shaft 24 while being guided by the engaging pin 34 and the slots 22*a*, 22*b*. As a result, the shaft 24 is resiliently biased by the coil spring 36 disposed between the engaging pin 34 and the attachment 14 for enabling the sliding legs 57*a*, 57*b* of the head member 40 to be held against the window glass panel 92 under pressure.

Then, the primer supply system 70 is activated while moving the robot arm 90 in the direction of the arrow A.

More specifically, as shown in FIG. 5, the variable-speed motor 78 is energized to operate the fixeddisplacement pump 76 for supplying the primer from the tank 72 through the pipe 74 to the pipe 82. The supplied primer goes to the directional control valve 84, which is operated to introduce the primer from the pipe 88 into the passage 44 in the connector 38. At this time, the pressure of the primer supplied to the coating apparatus 10 is measured by the pressure sensor 86 connected to the pipe 82 between the fixed displacement pump 87 and the directional control valve 84. If the measured pressure falls out of a reference pressure range, then the controller 80 controls the variable speed motor 78 to regulate the flow rate of the primer as it is supplied from the fixed displacement pump 76 to the coating apparatus 10.

When a certain amount of primer is supplied to the passage 44 in the connector 38, the primer is discharged from the passage 46 via the hole 48 out of the opening 58 in the main body 50 of the head member 40. The discharged primer flows on and along the slanted surface 54 of the main body 50 into the gap between the recess 56 and the window glass panel 92. During this time, the sliding legs 57*a*, 57*b* of the head member 40 are being displaced in the direction of the arrow A by the robot arm 90, and the head member 40 is being slidably held resiliently against the window glass panel 92 under the resilient force from the coil spring 36. Therefore, the primer that has reached the gap between the recess 56 and the window glass panel 92 is coated on a peripheral edge of the window glass panel 92 as a primer layer 94 having a width corresponding to the width of the recess 56. Consequently, by moving the robot arm 90 along a desired path, the primer layer 94 can be applied to an entire area to be coated of the window glass panel 92 by the coating apparatus 10

According to the above embodiment, a primer layer 94 having a prescribed width and a uniform thickness can reliably be applied to the window glass panel 92, and the primer coating process can effectively be carried out over a long period of time.

More specifically, the coating apparatus 10 employs the head member 40, rather than a conventional brush, for coating the window glass panel 92 with a primer. The head member 40 has the recess 56 having a prescribed width in a direction normal to the coating direction in which the primer is applied, and also has the slanted surface 54 inclined upwardly and forwardly in the coating direction, the slanted surface 54 having the opening 58. As described above, a primer discharged from the opening 58 and flowing along the slanted surface 54 is spread by the wall surface 56*a* of the recess 56 when the primer is coated on the window glass panel 92. Consequently, the primer layer 94 which has a width corresponding to the width of the recess 56 can be applied to the window glass panel 92. The primer is prevented from flowing into an unnecessary area, making the thickness of the primer layer 94 irregular, and the primer layer 94 is prevented from being thinner than required and hence from failing to keeping necessary adhesion to an adhesive which will subsequently be applied.

Since the primer is coated using the head member 40, the coating apparatus 10 is much more durable than conventional primer applying brushes. The primer coating process can effectively be performed for a long period of time by the coating apparatus 10.

The coating apparatus 10 is capable of reliably coating a primer to the window glass panel 92 even when the area thereof which is to be coated is inclined. More specifically, the head member 40 is mounted on the holder member 30 of the shaft 24, and the connector 38 is inserted through the holes 32*a*, 32*b* in the holder member 30 and the hole 60 in the head member 40. Therefore, the head member 40 and the connector 38 are angularly movably mounted on the holder member 30. In the case where a peripheral edge of the window glass panel 92 is inclined as shown in FIG. 3, simply by displacing the robot arm 90 downwardly, the head member 40 and the connector 38 swing clockwise as indicated by the arrow in FIG. 3 upon engagement with the window glass panel 92, thus bringing the sliding legs 57*a*, 57*b* of the head member 40 into reliable abutment against the window glass panel 92. As a consequence, the robot arm 90 is not required to be displaced obliquely along the inclined window glass panel 92. A desired primer layer 94 can accurately be coated on the inclined window glass panel 92 through such a simple arrangement.

Figure 7:
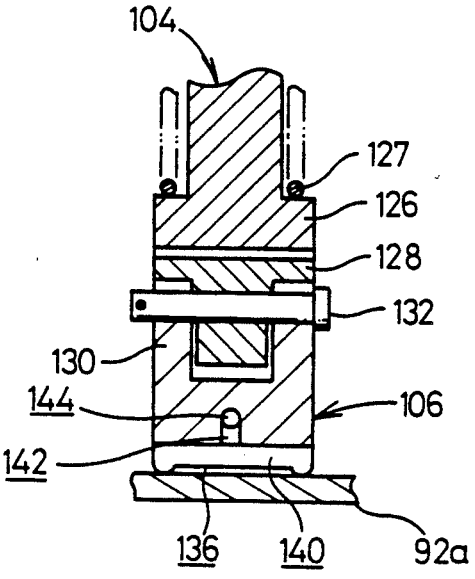
FIG. 7 is a cross-sectional view taken along line VII—VII of FIG. 6.

A coating apparatus according to another embodiment of the present invention will hereinafter be described with reference to FIGS. 6 through 8.

The coating apparatus, generally indicated by the reference numeral 100, is basically the same as the coating apparatus 10 of the first embodiment. The coating apparatus 100 comprises r holder 102, a shaft 104, and a head member 106. An attachment 108 is mounted on one end of the holder 102. The coating apparatus 100 is mounted on a robot arm 90*a* by the attachment 108. The holder 102 houses a check valve 110 having a valve chamber 112 communicating with a coating material supply device (not shown) and a spherical valve body 114 which is normally urged by a valve spring 113 for closing the lower end of the valve chamber 112. A chamber 116 is defined in the holder 102 below the valve chamber 112. The chamber 116 communicates with one end of a coating material supply pipe 118 with its other end connected to the head member 106 as described later on.

A shaft cover 120 is fixed to the lower end of the holder 102. The shaft 104 is vertically movably suspended by the shaft cover 120. The shaft 104 has on its upper part a first sliding portion 122*a* slidably fitted in the chamber 116 and a second sliding portion 122*b* spaced vertically from the first portion 122*a* and slidably held in the shaft cover 120. The first sliding portion 122*a* has a projection 124 extending centrally therefrom toward the valve body 114. A clevis 126 is attached to the lower end of the shaft 104 and normally urged downwardly by a compression coil spring 127 disposed between the clevis 126 and the shaft cover 120.

A support member 128 is angularly movably supported on the clevis 126. The head member 106 includes a head clevis 130 mounted on the support member 128 by a shaft 132 for angular movement in a direction normal to the direction in which the support member 128 is angularly movable. The head member 106 has on its lower end a pair of sliding legs 134 for sliding contact with a window glass panel 92*a* at front and rear positions in a coating direction indicated by the arrow A in FIG. 6. Each of the sliding legs 134 has a recess 136 defined in its lower tip surface and having a certain width in a direction normal to the coating direction. The head member 106 also has slanted surfaces 138 inclined from the sliding surfaces of the sliding legs 134 upwardly toward each other, thus defining a concave coating material reservoir 140 (FIGS. 6 and 7) between the sliding legs 134. The coating material reservoir 140 communicates with a coating material outlet 142 defined vertically in the head member 106 and communicating with the coating material pipe 118 through a passage 144 defined in the head member 106.

Operation and advantages of the coating apparatus 100 thus constructed will be described below.

The holder 102 installed on the robot arm 90*a* is moved over to a desired area on the window glass panel 92*a*, and he head member 106 is held against the window glass panel 92*a*. The holder 102 is then pressed against the win dow glass panel 92*a* to cause the shaft 104 to move relatively upwardly in the holder 102 and the shaft cover 120 against the resiliency of the coil spring 127. The projection 124 pushes the valve body 114 of the check valve 110 upwardly thereby to communicate the valve chamber 112 with the chamber 116, whereupon a coating material such as a primer is supplied from the coating material supply device (not shown) via the supply pipe 118 to he head member 106. Therefore, the primer is delivered from the passage 144 through the outlet 142 into the coating material reservoir 140.

Figure 8:
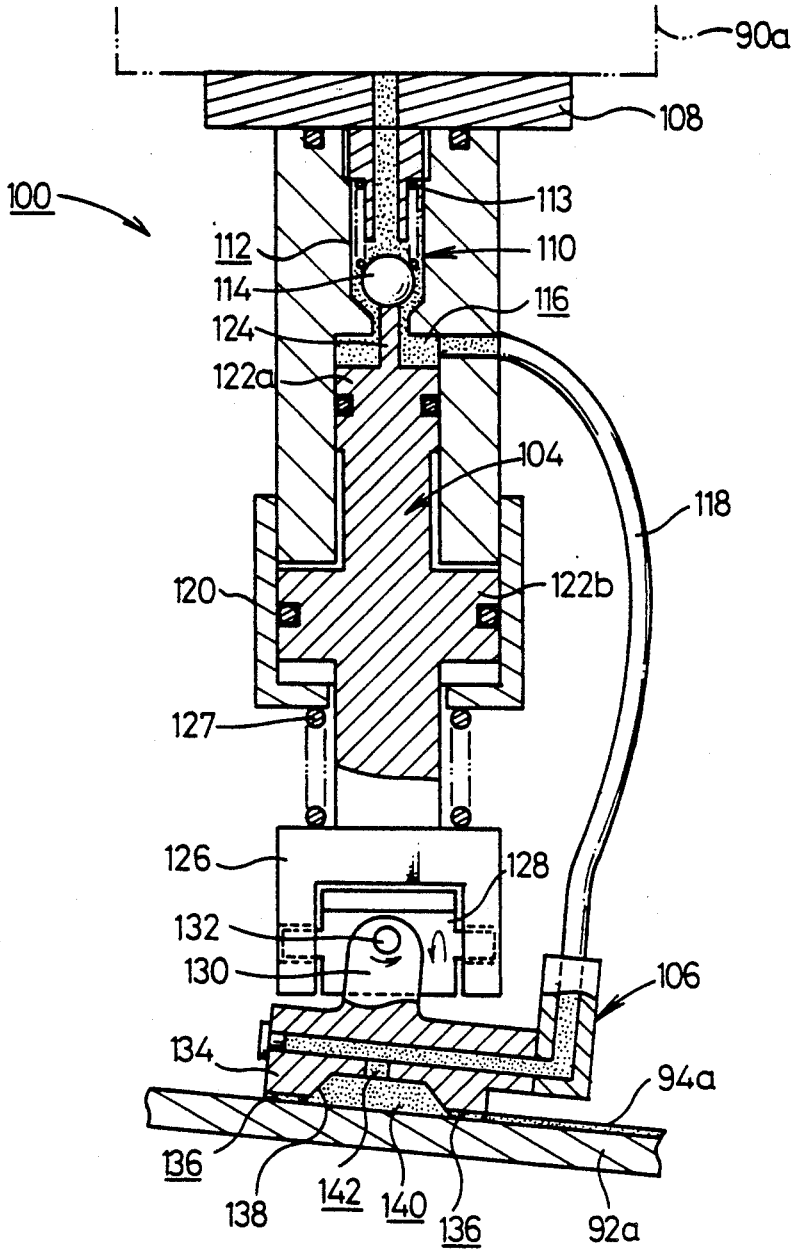
FIG. 8 is a cross sectional view explaining operation of the coating apparatus shown in FIG. 6.

As shown in FIG. 8, while the head member 106 is being pressed against the window glass panel 92*a*, the head member 106 is slid in the direction of the arrow A with the reservoir 140 being continuously filled with the primer. Since the primer filled in the reservoir 140 has a certain degree of viscosity, the primer is adhered to the window glass panel 92*a*. Upon sliding movement of the head member 106 in the direction of the arrow A, the primer in the reservoir 140 flows along the trailing slanted surface 138 and out of the trailing recess 136 of the head member 106 as a primer layer 94*a* on the window glass pane 92*a*. Inasmuch as the primer is held in the reservoir 140, a prescribed amount of primer can be supplied into the recess 136 even if the speed of movement of the head member 106 is varied while the primer is being coated. The window glass 92*a* is therefore coated with a high quality primer layer 94*a* having a uniform thickness.

In the coating apparatus 100, the support member 128 is angularly movably supported on the clevis 126, and the head member 106 is angularly movably mounted on the support member 128 for angular movement in a direction normal to the direction in which the support member 128 is angularly movable. Therefore, even in the case where the window glass panel 92*a* is three-dimensionally slanted, the head member 106 can be held in sliding contact with the window glass 92*a* by universal swinging movement of the head member 106.

When the coating process is over or intermitted, the head member 106 is lifted off the window glass panel 92*a* to release the shaft 104 of the downward pressure. The shaft 104 is depressed relatively to the holder 102 and the shaft cover 120 under the resiliency of the coil spring 127, until the second sliding portion 122*b* of the shaft 104 is supported by the shaft cover 120. Therefore, the projection 124 is lowered to release the valve body 114, which is then lowered under the bias of the valve spring 113 thereby closing the primer flow path. The supply of the primer toward the reservoir 140 is therefore cut off for thereby preventing unnecessary supply of the primer.

In the second embodiment, the sliding legs 134 have the respective recesses 136, and are slidable selectively in opposite directions in a coating process. However, only one of the sliding legs 134 may have a recess 136, and the head member 106 may be slid only in one direction with the sliding leg 134 with the recess 136 trailing behind in a coating process.

Still another embodiment of the present invention is shown in FIGS. 9 and 10. Those components shown in FIGS. 9 and 10 which are identical to those of the second embodiment are denoted by identical reference numerals, and will not be described in detail.

A coating apparatus 200 according to the third embodiment has a head member 106 including a pair of opposite side walls 140*a* disposed one on each side of a coating material reservoir 140 and joined to front and rear sliding legs 134. The side walls 140*a* are effective in more precisely defining a coating width across which a primer layer (not shown) is coated.

With the present invention, as described above, the coating apparatus has the head member for applying a coating material such as a primer to an object such as a window glass panel, the head member having the recess of a prescribed width and the coating material outlet opening positioned in front of the recess in the coating direction. Therefore, the coating material is supplied from the opening into the recess from which the coating material is applied to the object to form a coating layer which has a constant width and a uniform thickness. The coating apparatus is much more durable than the conventional brush, can be maintained and serviced with ease, and can effectively be used for a long period of time.

According to the present invention, moreover, the head member with the coating material outlet for supplying the coating material has the two sliding legs between which the concave coating material reservoir is defined. Consequently, by pressing and sliding the head member against the object to be coated while the coating material is being held in the coating material reservoir, the coating material in the reservoir can stably be supplied into the recess in a selected one of the sliding legs without being affected by changes in the speed of the coating process. It is thus possible to form a uniform coating layer of a constant width. The coating apparatus is simple in construction and can be maintained with ease.

Furthermore, the shaft which is normally urged downwardly is slidably disposed in the holder, and the head member is swingable in the coating direction and/or the direction normal to the coating direction. Even when the object to be coated is inclined or has a certain curved surface, the head member can reliably be held slidably against the object under certain pressure, so that a uniform coating layer of a constant width can be applied to the object. The check valve disposed in the coating material supply path can be opened and closed by the shaft which is vertically movable dependent on the slidable contact of the head member with the object. Therefore, any unwanted supply of the coating material ca be prevented when the object is should not be coated.

Although certain preferred embodiments have been shown and described, it should be understood that many changes and modifications may be made therein without departing from the scope of the appended claims.

What is claimed is:

1. A coating apparatus for coating an object with a coating material in a coating direction, comprising:

a holder adapted to be mounted on a controllable support member;

a shaft slidably supported in said holder;

a head member mounted on said shaft for angular movement with respect to said shaft, said head member having sliding surfaces for slidably contact with an object and a coating material outlet positioned forwardly of said sliding surface in the coating direction; and a recess defined between said sliding surfaces in fluid communication with said coating material outlet, said recess having a substantial width in a direction transverse to the coating direction and a greater widthwise dimension than said coating material outlet, wherein said coating material is uniformly applied to said object according to dimensions of said recess.

2. A coating apparatus according to claim 1, wherein said head member is angularly movably mounted with respect to said shaft by a connector, said connector having a passage having one end communicating with said coating material outlet and an opposite end adapted to communicate with a coating material supply source.

3. A coating apparatus according to claim 1, wherein said sliding surfaces have a recess defined therebetween to provide a gap between a portion of the coating head the object, the gap having a with in a direction transverse to the coating direction defining the width of the coating applied by the head member.

4. A coating apparatus according to claim 1, wherein said head member is movably mounted on said shaft by a connector so as to be angularly movable relative an axis of the shaft, said connector having a passage having one end communicating with said coating material outlet and an opposite end adapted to communicate with a coating material supply source, said material outlet being substantially centrally disposed about said axis.

5. A coating apparatus according to claim 1, wherein said head member includes a slanted surface inclined upwardly substantially from said sliding surfaces in the coating direction, said coating material outlet being defined in said slanted surface.

6. A coating apparatus according to claim 1 or 2, wherein said coating material outlet comprises a slit-like opening extending in a direction transverse to coating direction.

7. A coating apparatus according to claim 1 wherein said shaft is slidably supported in said holder under the bias of a resilient member, said shaft having an engaging pin and said holder having a slot in which said engaging pin is fitted, said shaft being guided by said engaging pin and said slot.

8. A coating apparatus for coating an object with a coating material in a coating direction, comprising:

a holder adapted to be mounted on a controllable support member;

a shaft slidably supported in said holder; and a head member mounted on said shaft, said head member having sliding legs for sliding contact with the object only at front and rear positions of said head member in the coating direction, at least one of said sliding legs having a recess defined therein to provide a gap between the sliding leg and the object, said gap having a desired width in a direction transverse to the coating direction, said sliding legs and a concave coating material reservoir defined between said sliding legs for temporarily storing the coating material supplied from said coating material outlet and for supplying the stored coating material into said recess.

9. A coating apparatus according to claim 8, wherein said sliding legs have respective inner surfaces defining said coating material reservoir therebetween and inclined upwardly toward each other.

10. A coating apparatus according to claim 8, further including opposing side wall members formed in connection with said sliding legs and parallel to the coating direction for confining the coating material to the prescribed width of said gap.

11. A coating apparatus according to claim 8, wherein said shaft is vertically movable and normally urged downwardly by a resilient member, said head member being swingably mounted on a distal end of said shaft for swinging movement in the coating direction and a direction transverse to the coating direction.

12. A coating apparatus according to claim 11, further including a clevis mounted on the distal end of said shaft, a support member swingably mounted on said clevis for swinging movement in one direction, said head member having a head clevis engaging said support member for swinging movement in a direction transverse to said one direction.

13. A coating apparatus according to claim 8 or 11, wherein said holder has a check valve disposed above said shaft supported therein and a coating material supply path communicating with the coating material outlet through said check valve, said check valve being selectively openable and closable by sliding displacement in said holder.

14. A coating apparatus for coating an object with a coating material in a coating direction, comprising:

a holder adapted to be mounted on a controllable support member;

a shaft slidably supported in said holder; and a head member having projecting leg portions defining a space therebetween such that a through slot exists between an end portion of said member and a substrate to be coated when said substrate is in contact with said legs, said head being mounted on said shaft by a pivot disposed substantially perpendicularly to a direction through said slot.

15. A coating apparatus according to claim 14, wherein said shaft is slidably supported in said holder under the bias of a resilient member, said shaft having an engaging pin and said holder having a slot in which said engaging pin is fitted, said shaft being guided by said engaging pin and said slot.

16. A coating apparatus according to claim 14, wherein said space has a prescribed width in a direction transverse to the coating direction.

17. A coating apparatus according to claim 14 or 16, wherein said head member is angularly movably mounted on said shaft by a connector, aid connector having a passage having one end communicating with said coating material outlet and an opposite end adapted to communicate with a coating material supply source.

18. A coating apparatus according to claim 14 or 16, wherein said head member includes a slanted surface inclined upwardly substantially from said sliding surface in the coating direction, said coating material outlet being defined in said slanted surface.

19. A coating apparatus for coating an object with a coating material in a coating direction, comprising:

a holder mountable on a controllable support member;

a shaft slidably supported in said holder and;

a head member mounted on said shaft for angular movement with respect to said shaft, said head member including a pair of leg members for slidably contacting said object to be coated, a wall member spaced apart from said object and connecting said pair of leg members, a recess defined by said pair of leg members and said wall member, and a coating outlet formed in said wall member forwardly of said pair of leg members and in fluid communication with said recess;

wherein said recess has a substantial width in a direction transverse to the coating direction and a greater widthwise dimension than said coating outlet thereby enabling application of a uniform height and width of coating material to said object.

* * * * *

UNITED STATES PATENT AND TRADEMARK OFFICE

CERTIFICATE OF CORRECTION

PATENT NO. 4,995,338

DATED February 26, 1991

INVENTOR(S) Hirobumi MORITA, Eiichi MATSUZAKI, Yukio CHIBA and Shigeo KATO

Figure 6:
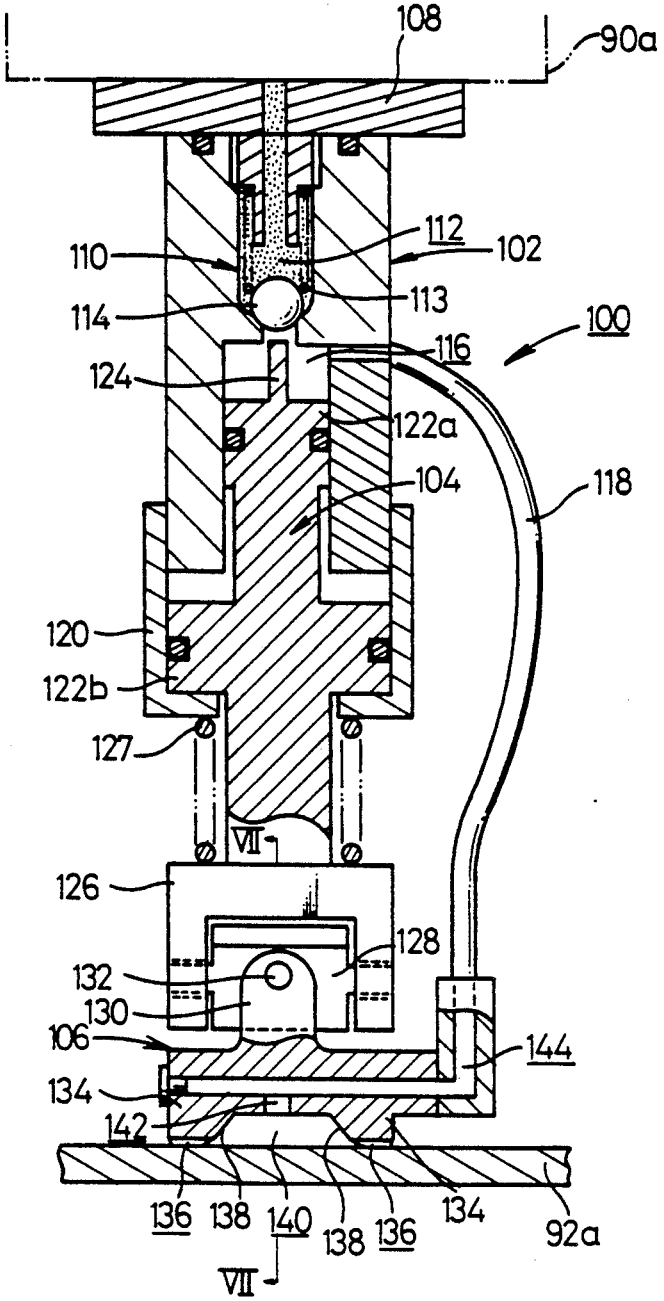
FIG. 6 is a fragmentary vertical cross-sectional view of a coating apparatus according to another embodiment of the present invention.

It is certified that error appears in the above-indentified patent and that said Letters Patent is hereby corrected as shown below:

In the Drawings, Figure 6, insert -- arrow A --

FIG.6

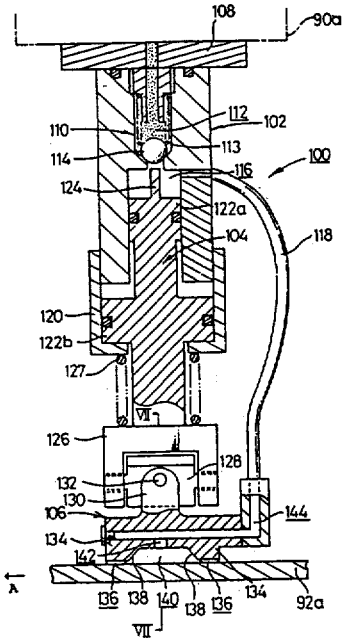

UNITED STATES PATENT AND TRADEMARK OFFICE

CERTIFICATE OF CORRECTION

PATENT NO. : 4,995,338

DATED : February 26, 1991

INVENTOR(S) : Hirobumi MORITA, Eiichi MATSUZAKI, Yukio CHIBA and Shigeo KATO

It is certified that error appears in the above-indentified patent and that said Letters Patent is hereby corrected as shown below:

In the Drawings, Figure 8, insert -- arrow A --

FIG.8

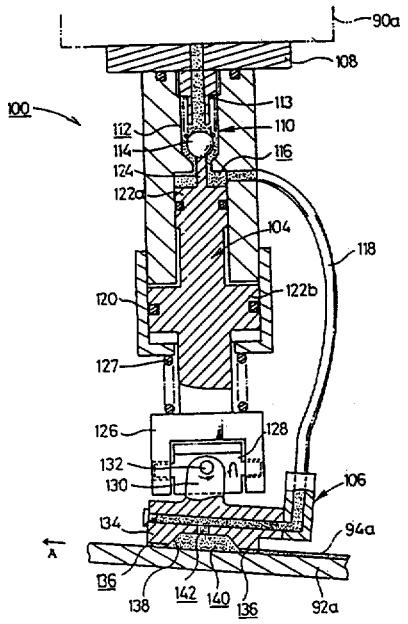

UNITED STATES PATENT AND TRADEMARK OFFICE

CERTIFICATE OF CORRECTION

PATENT NO. :4,995,338

DATED :February 26, 1991

INVENTOR(S) :Hirobumi MORITA, Eiichi MATSUZAKI, Yukio CHIBA and Shigeo KATO

It is certified that error appears in the above-indentified patent and that said Letters Patent is hereby corrected as shown below:

Column 9, Claim 1, line 8, change "slidably" to -- slidable --

Column 10, Claim 1, line 1, change "surface" to -- surfaces --

Column 10, Claim 3, line 3, after "head" insert -- and --

Column 10, Claim 3, line 4, change "with" to -- width --

Column 10, Claim 4, line 3, after "relative" insert -- to --

Column 10, Claim 6, line 3, before "coating" insert -- the --

UNITED STATES PATENT AND TRADEMARK OFFICE

CERTIFICATE OF CORRECTION

PATENT NO. :4,995,338

DATED :February 26, 1991

INVENTOR(S) :Hirobumi MORITA, Eiichi MATSUZAKI, Yukio CHIBA and Shigeo KATO

It is certified that error appears in the above-indentified patent and that said Letters Patent is hereby corrected as shown below:

Column 10, Claim 7, line 1, after "1" insert -- , -- (a comma)

Column 10, Claim 8, line 13, after "direction," insert -- said head having a coating material outlet defined between --

Column 10, Claim 8, line 16, change "said" to -- a --

Column 12, Claim 17, line 3, change "aid" to -- said --

Column 12, Claim 17, line 5, change "said" to -- a --

Column 12, Claim 18, line 4, change "said" to -- a --

Columm 12, Claim 19, line 5, change "and;" to -- ; and --

Signed and Sealed this

Eighteenth Day of April, 1995

Bruce Lehman

*Attest:*

BRUCE LEHMAN

*Commissioner of Patents and Trademarks*

*Attesting Officer*